United States Patent [19]

Hayward

[11] 4,280,783

[45] Jul. 28, 1981

[54] LOST MOTION LINKAGE ASSEMBLY FOR A FRONT LOADER

[76] Inventor: John A. D. Hayward, Knoll Farm, Damerham, Fordingbridge, Hampshire, SP6, England

[21] Appl. No.: 28,915

[22] Filed: Apr. 10, 1979

[51] Int. Cl.[3] ..... E02F 3/70

[52] U.S. Cl. ..... 414/686; 414/718; 414/720

[58] Field of Search ..... 414/708, 718, 719, 720, 414/686

[56] References Cited

U.S. PATENT DOCUMENTS

| | | | |
|---|---|---|---|
| Re. 23,466 | 3/1952 | McElhinney et al. | 414/718 |
| 2,471,639 | 5/1949 | McElhinney | 414/718 |
| 3,648,871 | 3/1972 | Layton | 414/718 X |
| 3,836,025 | 9/1974 | Olson et al. | 414/718 X |
| 3,952,896 | 4/1976 | Hayward | 414/708 |
| 4,162,873 | 7/1979 | Smith | 414/718 |

FOREIGN PATENT DOCUMENTS

| | | | |
|---|---|---|---|
| 738098 | 10/1955 | United Kingdom | 414/718 |

*Primary Examiner*—Leslie J. Paperner

[57] ABSTRACT

A hydraulic linkage which is usable as a front loader on an agricultural or other tractor (1) comprises at least one jib, and usually two interconnected jibs (5, 6, 9) which jibs are upwardly and downwardly turnable about an axis (3) relative to frame means (2). Each jib (5, 6, 9) comprises telescopic firt (5) and second (6) portions and the second portions (6) are extendible from the first portions (5) during raising of the jibs so that a load-/apparatus carried at the outer end (9) of each second portion (6) is raised substantially vertically, rather than arcuately about said axis (3). Spring (44) operated lost-motion mechanism prevents such extension during a lower arc of movement of the jibs (5, 6, 9) about said axis (3). Raising and lowering is effected by hydraulic rams (13) which preferably have chambers constantly linked by ducts (26) to chambers of second hydraulic rams (17) in such a way that any load/apparatus can automatically be maintained in a chosen attitude to the horizontal during raising or lowering of the jibs (5, 6, 9). The linkage provides improved stability, a substantially constant length of forward reach, improved vertical reach and the facility for automatic self-levelling of loads/apparatuses which are carried thereby.

10 Claims, 3 Drawing Figures

LOST MOTION LINKAGE ASSEMBLY FOR A FRONT LOADER

Figure 1:
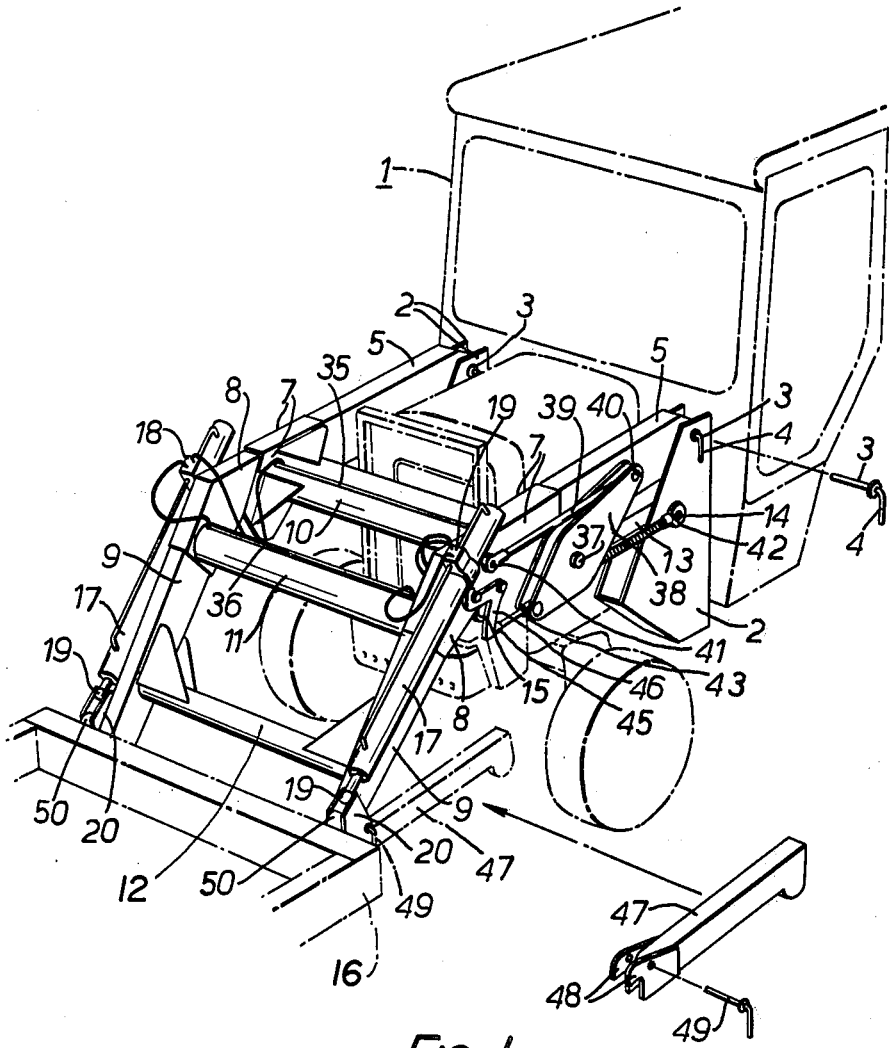

This invention relates to hydraulic linkages.

General objects of the invention include the provision of a hydraulic linkage that is suitable for agricultural use as a front loader and for civil engineering and other purposes, the linkage being of a simple and reliable construction which nevertheless provides a substantially constant length of forward reach, improved stability and improved vertical reach as compared with known hydraulic linkages that are of similar capacity. Advantageously, the linkage provides the facility for automatic self-levelling of a load or apparatus which it carries when in use and this is particularly desirable when the linkage is to be used by relatively inexperienced operators and/or with certain loads or apparatuses, such as fork lifts.

According to one aspect of the invention, there is provided a hydraulic linkage comprising frame means attached or attachable to a vehicle, at least one loading arm or jib of variable length that is turnable upwardly and downwardly relative to the frame means, mechanism which automatically increases the length of said arm or jib during raising thereof and automatically decreases the length of the arm or jib as it is subsequently lowered, and a lost-motion connection which renders said mechanism inoperative throughout a predetermined lower portion of the path of upward and downward turning movement of the arm or jib.

According to another aspect of the invention, there is provided a hydraulic linkage comprising frame means attached or attachable to a vehicle, at least one loading arm or jib of variable length that is turnable upwardly and downwardly relative to the frame means, and mechanism which automatically increases the length of said arm or jib during raising thereof through an upper portion of the turning movement of the arm or jib and automatically decreases the length of the arm or jib as it is subsequently lowered through the upper portion of said turning movement, said mechanism including a spring means which, throughout a predetermined lower portion of the path of turning movement of the arm or jib, biasses the arm or jib towards a minimum length position irrespective of whether the jib is turning upwardly or downwardly relative to the frame means.

In either of the above aspects, the invention may further comprise at least one first double-acting hydraulic ram that is pivoted between a part of said frame means which, in the use of the linkage, occupies a fixed position relative to said vehicle and a first jib portion in such a way that, as seen in side elevation, the axis of turnability of the arm or jib and the pivotal connections of said first ram are at the corners of a first triangle; mounting means for a load or apparatus, which mounting means is pivotally located at or near the end remote from said first jib portion of a second jib portion that is displaceable by said mechanism relative to the first jib portion; at least one second double-acting hydraulic ram pivoted between said mounting means and a location on said second jib portion which is spaced from the mounting means in such a way that, as seen in side elevation, the pivotal connections between the second jib portion and said mounting means and the pivotal connections of the second ram or rams are at the corners of a second triangle; and a hydraulic duct interconnecting the cylinder of the or each first ram and the corresponding cylinder of the or each second ram in such a way that hydraulic pressure medium expelled from the or each first ram cylinder by movement of the piston thereof will pass through the duct or corresponding duct to the or each corresponding second ram cylinder and cause movement of the piston thereof.

Advantageously, in the case just outlined, the or each hydraulic duct directly and constantly interconnects a cylinder chamber at one side of the piston of the or each first ram and a cylinder chamber at the opposite side of the piston of the or each corresponding second ram so that, when hydraulic pressure medium expelled from one such first ram chamber passes through the duct or corresponding duct to the corresponding second ram chamber and causes movement of the piston of that second ram, the attitude of said load or apparatus to be lifted and lowered by the linkage will be controlled in a predetermined manner during such lifting and lowering.

In a further development of the arrangement just outlined, the displacements of the first and second rams or of corresponding first and second rams are in inverse ratio to the lengths of corresponding sides of said first and second triangles defined by the linkage pivots, thus causing said load or apparatus to be maintained in a substantially unchanged attitude during lifting and lowering of the linkage.

In any of the arrangements outlined above, said mechanism which automatically increases and decreases the length of the arm or jib during raising and lowering thereof comprises a folding mechanical linkage.

Figure 2:
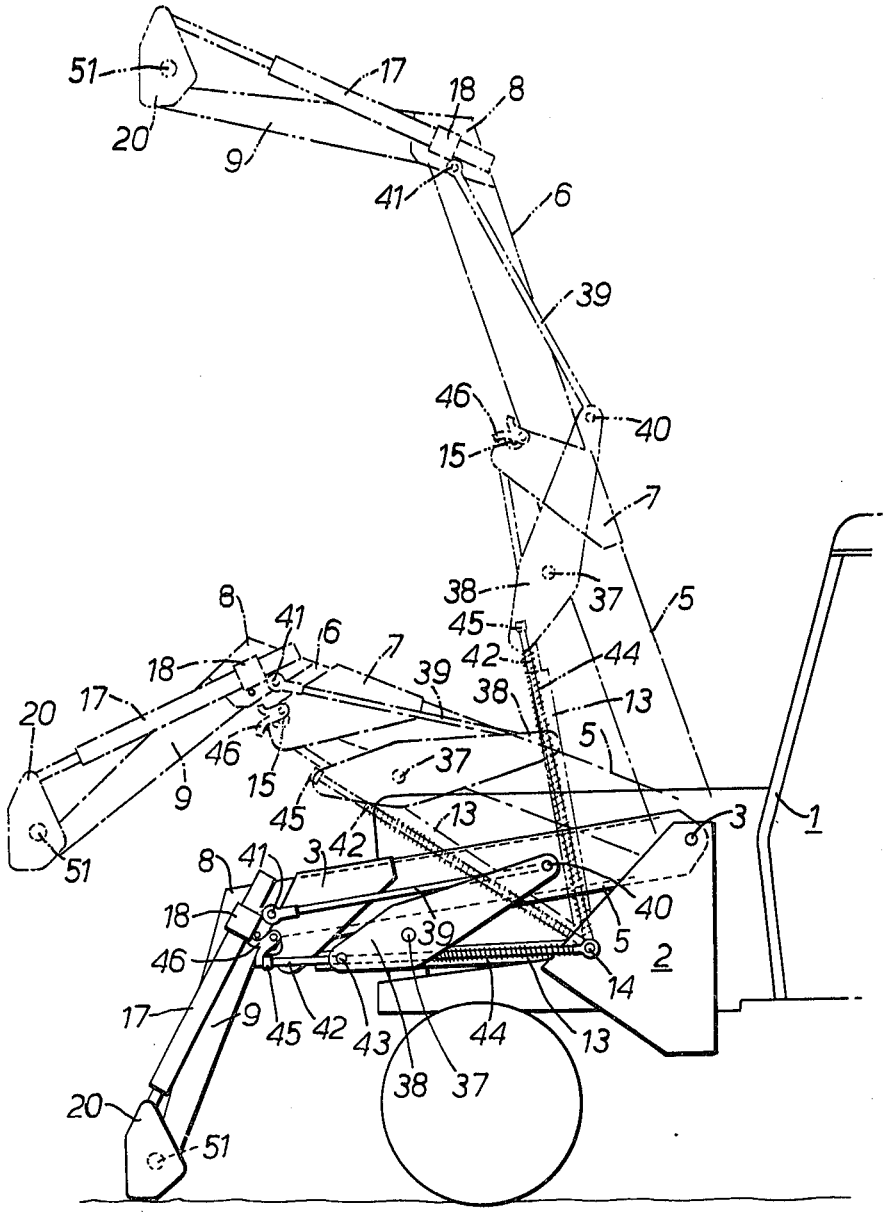
Figure 3:
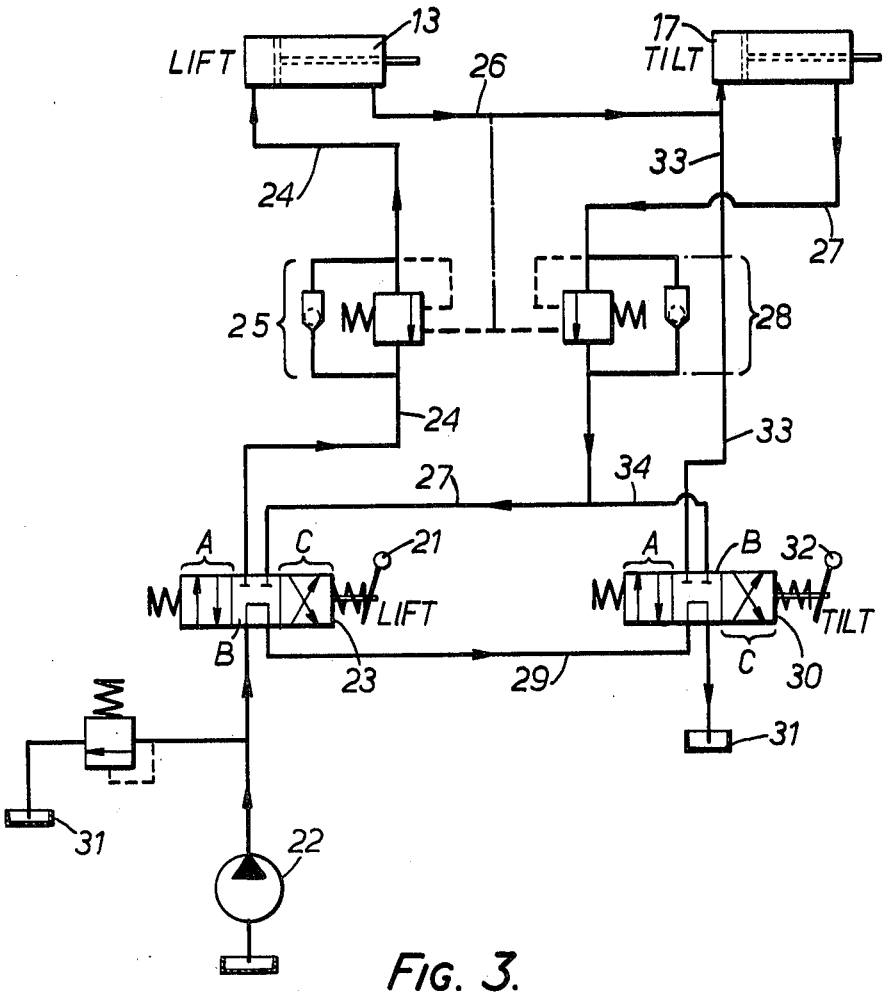

For a better understanding of the invention, and to show how the same may be carried into effect, reference will now be made, by way of example, to the accompanying drawings, in which:

FIG. 1 is a front perspective view of an agricultural tractor furnished with a hydraulic linkage in accordance with the invention, FIG. 2 is a side elevation illustrating the hydraulic linkage in a lowered position in full lines and in intermediate and substantially fully raised positions in broken lines, and FIG. 3 is a diagram illustrating the hydraulic circuit of the linkage and the controls thereof that are carried by an operating tractor or other vehicle.

Referring to the drawings, FIGS. 1 and 2 thereof diagrammatically illustrate an agricultural tractor 1 which it is not necessary to describe in detail. Moreover, whilst a hydraulic linkage in accordance with the invention will find its primary usage as an attachment to an agricultural tractor, it is noted that said linkage could equally well be employed in conjunction with some other operating vehicle that is not an agricultural tractor, the linkage being, if preferred, provided as an integral part of the original equipment of the operating tractor or other vehicle rather than as a releasable attachment therefor. The tractor 1 that is shown diagrammatically in the accompanying drawings is provided with a hydraulic system incorporating at least one hydraulic pump 22 (FIG. 3) that will normally, but not essentially, be operated by the internal combustion engine of the tractor that propels the latter over the ground during operative or inoperative travel thereof. The hydraulic linkage includes frame means in the form of mounting brackets 2 that occupy a fixed position relative to the tractor 1 during the use of the tractor/-linkage combination, said mounting brackets 2 being bolted, clamped and/or otherwise rigidly secured to the tractor frame and/or chassis in a manner which may be substantially conventional and which allows the brackets 2 to occupy fixed upright positions at opposite lateral sides of the tractor 1. Upper regions of the two brackets 2 carry pivots 3 that are in aligned relationship so as to define a substantially horizontal axis that occupies a fixed position relative to the tractor 1 at times when the linkage is secured to that tractor so as to function in combination therewith. It will be seen from FIG. 1 of the drawings that the pivots 3 incorporate handles 4 which allow them readily to be released from their operative positions, such pivots 3 being well known per se.

Two loader arms or jibs are turnable upwardly and downwardly about the corresponding two substantially coaxially aligned pivots 3, said loader arms or jibs thus being located at opposite lateral sides of the tractor 1. The two loader arms or jibs are both of telescopic formation and each of them comprises a first or outer jib portion 5 which is directly turnable upwardly and downwardly about the corresponding pivot 3 and a second or inner jib portion 6 which is telescopically movable relative to the respective outer jib portion 5 towards and away from the corresponding pivot 3. Both portions 5 and 6 of each loading arm or jib are afforded by hollow steel beams of oblong cross-section, each inner jib portion 6 being, naturally, of a little smaller cross-sectional dimensions than the corresponding outer jib portion 5 to enable said portion 6 to be received telescopically inside the co-operating portion 5. Rollers that are not visible in the drawings are arranged between the what would otherwise be contacting surfaces of the beams of said jib portions 5 and 6 to ensure that the portions 6 will be able to move telescopically with respect to the portions 5 without significant deflections from paths of axial displacement and without the wear and consequent danger of corrosion that would otherwise quite quickly occur if the surfaces of the telescopically movable beams were in direct sliding contact with one another.

The ends of the outer jib portions 5 of the loading arms or jibs that are remote from the corresponding pivots 3 are provided at their opposite sides with pairs of upright stop plates 7 which stop plates 7 may conveniently, as illustrated, be integrally interconnected at their upper edges. When the inner jib portions 6 of the loading arms or jibs are withdrawn as far as is possible into the outer jib portions 5, junction plates 8 which are rigidly secured to said inner jib portions 6 abut firmly against edges of the pairs of stop plates 7, the arrangement being such that said plates 8 make contact with the plates 7, under these circumstances, throughout a significant area so that the abutment pressure, during use, will not be excessive. The junction plates 8 rigidly connect end portions 9 of the two loading arms or jibs to the respective inner jib portions 6 and it will be seen from FIG. 2 of the drawings that, in side elevation, an angle of substantially 120° is enclosed at each junction plate 8 between the longitudinal axes of the corresponding inner jib portion 6 and end portion 9. The inner stop plates 7 of the two pairs thereof are perpendicularly and rigidly interconnected by a substantially horizontal beam 10 and, similarly, the junction plates 8 are perpendicularly and rigidly interconnected by a substantially horizontal beam 11. A third parallel beam 12 rigidly interconnects the end portions 9 of the loading arms or jibs at locations towards, but spaced from, the extremities of those portions 9 that are remote from the junction plates 8. As can be seen in FIG. 1 of the drawings, substantially triangular strengthening plates reinforce the rigidity of the connections of the beam 10 to the stop plates 7 and the beam 12 to the loading arm or jib end portions 9.

Two first hydraulic rams 13 are arranged at opposite sides of the tractor 1 in substantially symmetrically similar dispositions. Each first hydraulic ram 13 is a double-acting ram, the base of its cylinder being connected to the corresponding mounting bracket 2 by a substantially horizontal pivot 14 of removable formation and the free end of its piston rod being connected to portions of the corresponding pair of stop plates 7 by a substantially horizontal pivot 15 that is parallel to the pivots 3 and 14, said portions of the stop plates 7 being so disposed that they project downwardly beneath the bottom of the outer jib portion 5 concerned when that jib portion is horizontally or substantially horizontally disposed.

The extremities of the jib end portions 9 that are remote from the junction plates 8 are connected by substantially horizontal pivots which are not visible in the accompanying drawings to mounting means in the form of corresponding quadrants 20 that will be further described below and said quadrants 20 releasably carry a load or apparatus 16. The quadrants 20 are rigidly interconnected by a beam 51. The load or apparatus 16 is illustrated diagrammatically in only FIG. 1 of the accompanying drawings since it may be of any one of a number of different forms. Purely for example, the load or apparatus 16 could be a bale lifting implement, a scraper, an excavating bucket or a toothed or other scoop intended for dealing with soil, slurry or other material. Two second hydraulic rams 17 are arranged in substantially symmetrical relationship at opposite sides of the tractor 1 with a location close to the base of the cylinder of each ram 17 connected by a substantially horizontal pivot that is not actually visible in the drawings to the outer surface of the corresponding junction plate 8. The substantially horizontal pivots that have just been mentioned are located adjacent to hydraulic duct mountings 18 whose positions are visible in FIGS. 1 and 2. The free end of the piston rod of each second hydraulic ram 17, which is also a double-acting ram, is connected by a substantially horizontal pivot 19 to the corresponding quadrant 20, said load or apparatus 16 being effectively rigid with the quadrant 20 when the load or apparatus is operatively connected to the hydraulic linkage by the quadrants. It will be noted that the axes defined by the pivots 3, 14 and 15 and those defined by the pivots 19 and the pivotal connections of the second hydraulic rams 17 to the junction plates 8 and the end portions 9 of the loading arms or jibs to the quadrants 20 carrying the load or apparatus 16 are all parallel or substantially parallel to one another, the pivots 15 being spaced from the pivotal connections of the second hydraulic rams 17 to the junction plates 8 even when the inner jib portions 6 of said loading arms or jibs are fully retracted into the outer jib portions 5.

As previously mentioned, both the first and second hydraulic rams 13 and 17 are double-acting rams, the hydraulic connections thereto being shown diagrammatically in FIGS. 1 and 3 of the drawings but being omitted, for the sake of clarity, in FIG. 2 thereof. The hydraulic connections are afforded by conventional rigid and flexible pressure-resistant ducts. A first control 21 (FIG. 3) will normally be located inside the driving cab of the tractor 1 in a position in which it is readily accessible to the driver of that tractor and can be operated to move a spring-centred spool valve 23 to which it is connected into a position in which a portion "A" of said valve 23 is rendered operative. When said portion A is in an effective position, it causes the aforementioned pump 22 forming part of the hydraulic system of the tractor 1 to direct oil or other hydraulic pressure medium through the ducts in the directions indicated by arrows in FIG. 3 and turn the loading arms or jibs upwardly about the axis defined by the pivots 3. A first duct 24 delivers oil under pressure to a first chamber at the base end of the corresponding first ram 13 by way of an over-centre valve 25 whose function will be referred to below. A second duct 26 directly and constantly connects a second annular chamber at the end of the cylinder of the first ram 13 which is illustrated in FIG. 3 of the drawings and that is remote from the corresponding pivot 14 to a first chamber at the base end of the cylinder of the corresponding second hydraulic ram 17 so that, when oil delivered from the first duct 24 displaces the piston of the illustrated (in FIG. 3) first ram 13 away from the base end of its cylinder, oil in advance of that piston will be expelled from said cylinder and fed through the second duct 26 to the base end of the cylinder of the illustrated (again, in FIG. 3) second ram 17. A third duct 27 connects a second annular chamber which is at the end of the second ram 17 remote from its pivotal connection to the corresponding junction plate 8 to the spring-controlled spool valve 23 by way of a further over-centre valve 28. The oil returned from the third duct 27 through the portion A of the valve 23 is fed from that valve through a return duct 29 and a portion "B" of a second spring-centred spool valve 30 to a reservoir 31 of the tractor's hydraulic system so as to be available for subsequent reuse. Advantageously, but not essentially, the two spool valves 23 and 30 may be incorporated in a single valve block operatively positioned in the cab of the tractor 1.

A second control 32 is operatively connected to the second spring-centred spool valve 30 and a delivery duct 33 extends therefrom to a junction with the corresponding second duct 26 so that oil under pressure can be fed direct to the first chamber at the base end of the cylinder of the corresponding second ram 17 to increase the volume of oil disposed in that first chamber (of the second ram 17) and the second annular chamber of the corresponding first ram 13, that is to say, the oil that is located between the leading right-hand surface (as seen in FIG. 3) of the piston of the illustrated first ram 13 and the trailing left-hand surface of the piston of the illustrated second ram 17. All that is necessary to bring about an increase in the volume of this "trapped" oil is to release the first control 21 so that a portion "B" of the valve 23 becomes effective and to operate the second control 32 so that a portion "A" of the second spring-centred spool valve 30 becomes effective. Oil from the pump (or pumps) 22 is then fed to the delivery duct 33 by way of the portion B of the valve 23, the duct 29 and the portion A of the valve 30. Oil expelled from the second annular chamber of the second hydraulic ram 17 that is illustrated in FIG. 3 of the drawings in advance of the piston of that ram returns to the reservoir 31 by way of the third duct 27, the over-centre valve 28, a duct 34 and the portion A of the second valve 30. This operation of the second valve 30 causes the quadrants 20 to tilt the load or apparatus 16 upwardly. The first and second controls 21 and 32 can, of course, be operated to bring portions "C" of the corresponding spool valves 23 and 30 into operative positions and it will be apparent that, under these circumstances, the directions of flow of oil or other hydraulic pressure medium that are illustrated in FIG. 3 and/or that have been described above will be reversed. The portion C of the valve 23 is employed when lowering of the loading arms or jibs of the linkage is required and the portion C of the spool valve 30 is employed when downward tilting of the quadrants 20 (in an opposite direction to that discussed above) is necessary.

The linkage that is illustrated by way of example in FIGS. 1 and 2 of the drawings comprises two first rams 13 and two second rams 17 located at opposite sides of the tractor 1. In order to ensure that uniform hydraulic pressure will necessarily exist at all times in the ducts and cylinders corresponding to the rams 13 and 17 of both pairs, the ducts, 24, 26, 27 and 33 are duplicated and cross connections are provided between the two ducts 24, the two ducts 26 and the two ducts 27. The cross connection that extends between the two ducts 26 is indicated by the reference 35 in FIG. 1 of the drawings and, similarly, the cross connection that extends between the two ducts 33 is indicated by the reference 36 in FIG. 1 of the drawings.

Lugs that are not visible in the drawings depend from the lower edges of the outer jib portions 5 of the loading arms or jibs of the hydraulic linkage and carry substantially horizontal pivots 37 which are in parallel relationship with the other pivots of the linkage that have been discussed above. Pairs of spaced plates 38 are turnable about the pivots 37 and connecting rods 39 which lie between the two plates 38 of each pair couple together substantially horizontal pivots 40 at corners of said plates 38 that are remote from the pivots 37 and still further substantially horizontal pivots 41 which are secured to the junction plates 8 carried by the inner jib portions 6 of the loading arms or jibs.

In addition to supporting the base ends of the cylinders of the first hydraulic rams 13 in a pivotable manner, the substantially horizontal pivots 14 turnably connect the ends of rods 42 to the respective mounting brackets 2. Each of said rods 42 extends, from the corresponding pivot 14, between the pair of spaced plates 38 at the same side of the tractor 1 and slidably through a plain transverse bore in a block 43 that is turnably mounted, by trunnion pins, relative to said plates 38 about an axis which is parallel to the axes defined by the pivots 37 and 40 and the further pivots which have been referred to above. Spring means in the form of a helical compression spring 44 is wound around each rod 42 so as to bear between a collar closely adjacent to the corresponding pivot 14 and that side of the corresponding block 43 which faces the pivot 14 concerned. The springs 44 thus tend to slide the blocks 43 away from the pivots 14 which causes the pairs of plates 38 to be turned about the pivots 37 in a clockwise direction as seen in FIGS. 1 and 2 of the drawings until the junction plates 8 that are carried by the inner jib portions 6 are in firmly abutting relationship with the stop plates 7 carried by the outer jib portions 5, it being remembered that said junction plates 8 are coupled to the pairs of plates 38 by the corresponding connecting rods 39. The ends of the rods 42 which are remote from the pivots 14, and that are thus located at the opposite sides of the corresponding blocks 43 to those against which the ends of the springs 44 bear, carry terminal enlargements 45 that are too large to pass through the transverse bores in the blocks 43.

The over-centre valves 25 and 28 that are diagrammatically illustrated in FIG. 3 of the drawings are commercially available pilot-assisted valves that serve to prevent a heavy load from running away, usually under the action of gravity, ahead of the pump that is supplying oil to move that load in the required direction. In the apparatus that is being described, such running ahead during lowering would involve the passage of oil through one of the ducts to the reservoir 31 but, if a predetermined positive pressure is not maintained in the ducts 26, the pilot portions of the over-centre valves 25 and 28 that are included in the ducts 24 and 27 severely throttle or completely close those ducts (when functioning as "return" ducts) so that the tendency to "run away" is overcome. Commercially available pilot-assisted over-centre valves that are suitable for service as the valves 25 and 28 are manufactured by Fluid Controls Inc. of Mentor, Ohio, U.S.A. and can be obtained in Great Britain from Integrated Hydraulics Company Limited of Leamington Spa, Warwickshire.

In the use of the hydraulic linkage that has been described and that is illustrated, by way of example, in the accompanying drawings, it is assumed, for discussion purposes, that said linkage occupies the initial lowered position shown in full lines in FIGS. 1 and 2 of the drawings in which the load or apparatus 16 that is carried by the quadrants 20 of the linkage is at, or substantially at, ground level. Upon the driver of the tractor 1 moving the first control 21 (FIG. 3) into such a position that the portion A of the spring-centred spool valve 23 is rendered operative, oil or other hydraulic pressure medium from the reservoir 31 will be fed by the pump 22 to the first chambers at the base ends of the two first hydraulic rams 13 and thus to the left-hand end of the cylinder of the single ram 13 that is shown in FIG. 3. The piston rods of the rams 13 will thus be progressively extended from the cylinders thereof and this causes the whole of each of the two loading arms or jibs to turn upwardly in a clockwise direction as seen in FIGS. 1 and 2 about the substantially horizontally aligned pivots 3 relative to the mounting brackets 2. Oil displaced from the second annular chambers of the two rams 13 passes by way of the interconnected second ducts 26 to the first chambers at the base ends of the cylinders of the second hydraulic rams 17 and thus to the left-hand end of the cylinder of the single ram 17 that is illustrated in FIG. 3. The piston rods of the second rams 17 thus progressively extend from their cylinders and turn the load or apparatus 16 and the quadrants 20 which carry it in an anticlockwise direction, as seen in FIGS. 1 and 2 of the drawings, about the aligned pivotal connections of the quadrants 20 to the two end portions 9 of the loading arms or jibs. It is particularly noted that, as seen in side elevation (FIG. 2), the pivots 3, 14 and 15 are at the three corners of a first triangle whilst the pivots that substantially coincide in position with the hydraulic duct mountings 18, the pivots 19 and the pivotal connections of the jib end portions 9 to the quadrants 20 carrying the load or apparatus 16 are at the three corners of a second triangle. In the particular example that is being described, the first and second triangles are similar or substantially similar and, with this arrangement, entirely automatic self-levelling of the load or apparatus 16 (i.e. automatic maintenance of a predetermined attitude thereof to the horizontal and to the vertical during lifting and lowering) is achieved by having the same ratio between the oil displacements of the interconnected chambers of the first and second hydraulic rams 17 and 13 as exists between the sizes of said first and second triangles. It should, of course, be borne in mind that the chambers at the opposite sides of the pistons in the rams 13 and 17 are not of equal volume per unit length because, at one side of each piston, the corresponding piston rod occupies a considerable proportion of the volume concerned, thus rendering the chamber in question annular in configuration. In the example under consideration, the annular chambers of the first rams 13 are in communication with the non-annular chambers of the second rams 17 but it is noted that the described and illustrated positions of the rams 13 and 17, as regards their base and opposite ends, are not essential and either or both could be reversed in this respect with a mere rearrangement of the hydraulic ducts that are coupled thereto. When the first triangle is larger than the second triangle, as in the present case, the oil displacement of the non-annular chambers of the second rams 17 should be larger than that of the annular chambers of the first rams 13 in the same ratio as exists between the sizes of said first and second triangles if automatic self-levelling of the load or apparatus is required. The rams 13 and 17 may be identical rams and the desired relationship be attained by an appropriate choice of the triangle sizes and piston rod diameters. Advantageously, the second rams 17 are smaller than the first rams 13, the same variable design features being usable to attain the desired relationship.

Clearly, the relationship between the sizes of the first and second triangles and the oil displacements of the interconnected chambers of the first and second hydraulic rams 13 and 17 that has been discussed in the preceding paragraph is not essential. It might be desirable for some purposes that the attitude of the load or apparatus 16 to the horizontal and to the vertical should change in an automatically controlled manner during lifting and in the reverse of that manner during lowering and this can readily be attained by an appropriate choice of the dimensions of the two triangles and of the oil displacements of the interconnected chambers of the first and second rams. If the first and second triangles are congruent or substantially congruent, self-levelling can be attained using first and second rams 13 and 17 that are of different dimensions provided that the interconnected annular and non-annular chambers thereof exhibit identical oil displacement characteristics. The above-mentioned advantageous construction in which the dimensions of the second rams 17 are smaller than those of the first rams 13 can thus readily be obtained by matching the oil displacements of the annular first ram chambers with those of the communicating non-annular chambers of the bodily smaller second rams 17.

If the operator of the tractor 1 wishes to tilt the load or apparatus 16 at any level thereof above the ground surface, for example, to empty a scoop or bucket, he allows the springs of the valve 23 to bring the central portion B thereof into operation and then moves the second control 32 to render either portion A or portion C of the second spool valve 30 effective depending upon whether the load or apparatus 16 is to be tilted upwardly or downwardly. Such tilting takes place without alteration of the angular positions of the loading arms or jibs about the substantially horizontal axis defined by the pivots 3. Lowering of the loading arms or jibs and the load or apparatus 16 which their quadrants carry is effected merely by causing the first control 21 to bring the portion C of the spool valve 23 into an operative position. The directions of flow that are indicated by arrows in FIG. 3 of the drawings are then reversed and the load or apparatus 16 returns towards the ground maintaining its attitude to the horizontal and to the vertical upon the assumption that the whole linkage is self-levelling as discussed above.

In addition to automatic self-levelling or an automatically achieved predetermined change in the attitude of the load or apparatus 16 to the horizontal and to the vertical during lifting and lowering, the loading arms or jibs automatically extend during lifting and automatically retract during lowering. In the initial lowered position which is illustrated in full lines in FIGS. 1 and 2 of the drawings, the compressed springs 44 maintain the junction plates 8 in abutting contact with the stop plates 7 so that the loading arms or jibs are at their minimum length. As said arms or jibs turn upwardly about the pivots 3, the springs 44 become progressively extended, whilst still maintaining the loading arms or jibs at their minimum lengths, until a point is reached, just before the intermediate position illustrated in broken lines in FIG. 2 of the drawings is attained, at which the terminal enlargements 45 on the rods 42 come into contact with the sides of the blocks 43 that are remote from the pivots 14. The blocks 43 are then incapable of moving any further away from the pivots 14 so that, upon further upward movement of the loading arms or jibs about the pivots 3, the pairs of spaced plates 38 are caused to turn in an anticlockwise direction as seen in FIG. 2 of the drawings about the pivots 37 by which they are connected to the outer jib portions 5. This turning movement is transmitted to the connecting rods 39 and can only be accommodated by telescopic extension of the inner jib portions 6 from the outer jib portions 5. The intermediate broken line position that is shown in FIG. 2 of the drawings illustrates a condition in which such telescopic extension has just commenced. FIG. 2 of the drawings also shows, in broken lines, a substantially fully raised position of the linkage in which the inner jib portions 6 are fully extended from the outer jib portions 5. As the loading arms or jibs are lowered, the springs 44 (together with a large but progressively reducing component of the weight of the inner jib portions 6 and of any load or apparatus 16 being carried) cause the plates 38 to turn back in a clockwise direction as seen in FIG. 2 about the axis defined by the pivots 37 which movement automatically retracts the inner jib portions 6 telescopically into the interiors of the outer jib portions 5. This retraction continues until the junction plates 8 come into abutting engagement with the stop plates 7 after which the rods 42 slide through the blocks 43, with continuing compression of the springs 44, until substantially the fully lowered position that is shown in full lines in FIGS. 1 and 2 of the drawings is reached.

The telescopic construction of the loading arms or jibs has considerable practical advantages. As can be seen best in FIG. 2 of the drawings, said arms or jibs have a substantially constant forward reach from the tractor which is extremely useful when, for example, material is being stacked since, even when the linkage is fully raised, any load or apparatus 16 carried by the quadrants 20 still lies forwardly of the front of the tractor 1 so that said tractor front is not hard against the side of a stack or the like. The load or apparatus 16 can be raised to a considerably greater height above ground level than would be possible with otherwise equivalent but non-extendible loading arms or jibs and the stability of the tractor 1 plus the linkage is improved because the loading arms or jibs are short when the linkage is lowered but are lengthened when it is raised so that the centre of gravity of the linkage remains close to the tractor 1. The load or apparatus 16 can be raised to a high level above the ground without it being necessary for the mounting brackets 2 to be correspondingly high as is required in non-extendible prior art constructions and the driver of the tractor 1 thus retains a broad field of vision without there being any blinkering effect that is attributable to the mounting brackets 2. It is noted that, due to the lost motion arrangement between the rods 42 and the relatively slidable blocks 43, the loading arms or jibs do not start to increase in length until they have been turned upwardly about the pivots 3 through a lower portion of the turning movement thereof so far that the load or apparatus 16 will be pushed principally upwardly, rather than forwardly, by such extension. Clearly, the angular position at which such telescopic extension automatically commences can be varied by altering the distance of the terminal enlargements 45 from the pivots 14 or the positions of the blocks 43 but it has been found that such extension advantageously commences when, as seen in FIG. 2 of the drawings, a plane containing the longitudinal axes of the outer jib portions 5 is inclined at substantially 30° to a substantially horizontal plane containing the axis defined by the pivots 3. A further advantage of this arrangement is that, when the load or apparatus 16 is a digging bucket or the like that is to be pushed forwardly with respect to the intended direction of forward travel of the tractor 1 into soil or other material, such digging will take place with the loading arms or jibs in a non-extended condition in which the stop plates 7 are in firm abutting engagement with the junction plates 8 thus preventing any deforming load being applied to the connecting rods 39.

The load or apparatus 16 may sometimes be in the form of a scraper bucket or the like that is intended to be filled by dragging it rearwardly through soil or other material in a direction that is the reverse of the intended forward direction of travel of the tractor 1. It will be realised that, under these circumstances, there will be a tendency for the inner jib portions 6 to be extended from the outer jib portions 5 against the action of the springs 44 and such uncontrolled extension is clearly undesirable. Accordingly, when such use is contemplated, a linkage catch 46 is pivotally mounted on the outer stop plate 7 of each pair of those stop plates. Each linkage catch 46 has an upper hooking limb that is arranged to co-operate with a stop pin carried by the corresponding junction plate 8 and a lower abutment limb that is arranged to co-operate with the corresponding terminal enlargement 45, said outer stop plate 7 also being provided with lower stops (see FIG. 2) to prevent the linkage catches 46 from turning too far downwardly about their pivotal connections to the stop plates 7. When the loading arms or jibs are in their lowered positions as discussed above and as illustrated in full lines in FIGS. 1 and 2 of the drawings, the terminal enlargements 45 of the rods 42 bear against the lower limbs of the corresponding linkage catches 46 and turn them upwardly out of contact with said lower stops into positions in which, as illustrated, the hooking limbs thereof make retaining engagement with the stop pins on the junction plates 8. The inner jib portions 6 are thus positively prevented from becoming extended from the outer jib portions 5 so that uncontrolled extensions cannot take place under the scraping/digging circumstances that have been discussed above. When the loading arms or jibs have been sufficiently raised about the pivots 3, the terminal enlargements 45 no longer engage the lower limbs of the linkage catches 46 so that gravity turns said catches 46 downwardly and releases the stop pins on the junction plates 8 from their hooked engagement with the upper limbs of the catches 46.

Other forms of linkage catch could be provided. For example, curved rods whose centres of curvature coincide with the common axis of the pivots 3 could be provided in fixed positions close to those pivots. The rods would be entered through holes in lower walls of the outer jib portions 5 and, when the arms or jibs were fully telescoped and of minimum length, through registering holes in lower walls of the inner jib portions 6. The curved rods would be of such lengths as to remain entered through the registering holes until the arms or jibs were raised to the level at which automatic extension thereof should commence and would thus function positively to prevent such extension throughout a lower portion of the upward and downward turning movement of the arms or jibs.

The hydraulic linkage that is illustrated in FIGS. 1 and 2 of the accompanying drawings is releasably connected to the tractor 1 and, in such a case, it is convenient, although by no means essential, to furnish the linkage with a pair of detachable parking legs 47 of which only one is shown in FIG. 1 of the drawings. When the linkage is to be disconnected from the tractor 1, shaped lugs 48 at one end of each leg 47 are connected to the quadrants 20 of the loading arm or jib end portions 9 by horizontal pins 49, said lugs 48 including portions which cooperate hookingly with cross shafts (not visible) of the quadrants 20. When the legs 47 are fitted, with the loading arms or jibs in their lowered position, judicious operation of the first control 21 will bring the linkage to a condition in which, because of the pressure of said legs 47 against the ground surface, both the pivots 3 and 14 can readily be removed from the mounting brackets 2. When such removal has been accomplished, the loose rods 42 and first rams 13 are preferably, but not essentially, prevented from falling downwardly by being linked temporarily to the respective overlying outer jib portions 5 by chains or the like (not shown). The flexible hydraulic ducts of the linkage are connected, in a conventional manner that is known per se, to the hydraulic system of the tractor 1 by quickly releasable self-sealing couplings and, once such couplings have been disengaged, the oil or other hydraulic pressure medium trapped within the ducts and the second rams 17 of the linkage prevents the loading arms or jibs thereof from turning downwardly about the pins 49 by which they are connected to the legs 47 and the tractor 1 can be driven carefully in a rearward direction out from between the arms or jibs of the linkage. Generally speaking, provided that no leakage of oil or other hydraulic pressure medium occurs, the linkage will remain in this condition until it is next required for use at which time it is only necessary to drive the tractor 1 carefully forwards until repositioning of the pivots 3 and 14 is possible. If desired, struts or the like (not shown) may be provided to maintain the loading arms or jibs positively in parked positions which are such that the apertures in the mounting brackets 2 and outer jib portions 5 will automatically be in substantial register to receive the pivots 3.

It is preferred, but is not essential, that the quadrants 20 at the leading extremities of the loading arm or jib end portions 9 should be constructed and arranged so as to be quickly connectible to, and disengageable from, a range of different loads or apparatuses 16 that are to be selectively carried by the hydraulic linkage. This involves providing each such load or apparatus 16 with at least two brackets 50 that are spaced apart from one another by the same distance as the spacing between the quadrants 20 and, if the brackets 50 are of a simple and relatively inexpensive construction, two or more pairs thereof may be provided on at least some of the different loads or apparatuses 16 so that each such load or apparatus may be disposed centrally in register with the path of travel of the tractor 1 or may be offset laterally towards the right-hand and/or left-hand side of that path of travel. The brackets 50 are not fully visible in FIG. 1 of the drawings but it is preferred that each of them should comprise a heavy upright portion welded or otherwise rigidly secured to a fixed part of the load or apparatus 16 concerned, said portion being basically strip-shaped and being formed at both its uppermost and lowermost ends with corresponding rearwardly directed arcuately curved hooks that subtend angles of substantially 180° at their centres of curvature. Cross shafts of the quadrants 20 are readily engageable with, and disengageable from, such brackets 50 but other known or suitable quickly releasable and engageable mechanisms could equally well be used. The quadrants 20 could also be fixedly connected to any particular load or apparatus 16 that is always to be used with the hydraulic linkage.

Whilst it is greatly preferred that the automatic extendibility of the telescopic loading arms or jibs should be employed in combination with the automatic self-levelling facility for any load or apparatus 16 as described above and as illustrated in the accompanying drawings, it is emphasised that this is not absolutely essential and that it is within the scope of the invention for the telescopic loading arms or jibs to be automatically extendible and retractible without also providing automatic self-levelling of the load or apparatus 16. Equally, it is possible to produce a hydraulic linkage in which automatic self-levelling is provided without the loading arms or jibs being extendible. My British Patent Specification No. 1,465,702 describes and illustrates a hydraulic linkage of this latter kind and reference may, if desired, be made to that Patent Specification for details of such a construction. It is also noted that, whilst mechanical means for increasing and decreasing the lengths of the loading arms or jibs during raising and lowering of the linkage has been described, this is not absolutely essential and the simple mechanical means that has been described and that is illustrated in the accompanying drawings may, if preferred, be replaced by an equivalent hydraulically operated mechanism. In most cases, the linkage will comprise two interconnected loading arms or jibs but it is within the scope of the invention to provide a linkage in which the load or apparatus is carried by only a single arm or jib. Such an embodiment may be preferable for some civil engineering applications and can be constructed so that the single arm or jib is located substantially centrally across the working width of the vehicle which releasably or integrally carries the linkage. Conversely, more than two interconnected arms or jibs could be provided.

I claim:

1. An improved linkage assembly comprising frame means attachable to a vehicle, said linkage including at least one loading jib of variable length that is turnable upwardly and downwardly relative to the frame means, means adapted to act on said jib for increasing the length of said jib during raising thereof and for decreasing the length of the jib as it is subsequently lowered, a lost-motion connection for rendering said means inoperative throughout a predetermined lower portion of the path of upward and downward turning movement of the jib, wherein: said jib is maintained in a minimum length position throughout said predetermined lower portion of the path of upward and downward turning movement thereof by a pair of plates that are pivotally connected to a first jib portion, said plates also being pivotally coupled to a second jib portion and to said frame means by way of said lost-motion connection so that, upon raising the jib from a lowered position, said lost-motion connection prevents pivotal movement of said pair of plates until a predetermined inclination of the jib to the horizontal has been attained and whereafter, said pair of plates is caused to pivot relative to the first jib portion, the pivotal movement thereof being employed to cause length-increasing displacement of the second jib portion relative to the first jib portion.

2. A linkage assembly according to claim 1, wherein: said lost-motion connection for the jib is caused to remain in its minimum length position at, and beneath, a disposition in which the first jib portion thereof is upwardly inclined at an angle of substantially 30° to a horizontal plane which contains the axis of turnability of that jib.

3. A linkage assembly as claimed in claim 1 or claim 2, wherein: said pair of plates that is pivotally connected to the first jib portion is coupled to said frame means by a pivotally mounted rod which is slidable with respect to said pair of plates, a spring for urging said plates into a predetermined angular position about their pivotal connection to the first jib portion, and wherein said slidable rod is provided with an enlargement which, when engaged by a member carried by said pair of plates, prevents further sliding movement of the rod relative to those plates in one direction.

4. A linkage assembly according to claim 3, wherein: the spring is a compression spring wound around the slidable connecting rod whereby, upon said member carried by said pair of plates being engaged by said enlargement, said member additionally tends to compress said spring upon further lowering of the jib.

5. An improved linkage according to claim 3, wherein: the enlargement is adjustable in position axially along said slidable connecting rod.

6. An improved linkage according to claim 1 or 2, wherein: the jib is provided with a linkage catch which is constructed and arranged positively to maintain said jib in substantially its minimum length position when said linkage catch is engaged.

7. An improved linkage according to claim 1 or 2, wherein: said linkage is releasably attachable to a vehicle and is provided with at least one parking leg whereby, said linkage when not connected to a cooperating vehicle, can be caused to engage the ground surface and maintain the linkage in a substantially upright parked position adapted to be re-connected to a cooperating vehicle.

8. An improved linkage according to claim 1 or 2, wherein: said second jib portion is telescopically movable relative to said first jib portion in directions towards, and away from, the axis of rotation of the jib, and said first and second jib portions are afforded by hollow beams of oblong cross-section, rollers being arranged between contacting surfaces of said telescopically movable beams, and said telescopically displaceable beams of said first and second jib portions carry plates which, when said second jib portion is withdrawn as far as possible into the first jib portion, form abutting surface-to-surface contact with one another throughout an area sufficient to avoid excessive abutment pressure when the linkage is in use.

9. An improved linkage according to claim 1 or 2, wherein: two substantially symmetrically identical loading jibs are provided, each such jib comprises first and second jib portions and said first jib portions being rigidly interconnected and said second jib portions being rigidly interconnected.

10. An improved linkage according to claim 1 or 2, wherein: two hydraulic controls are provided one of which is usable to raise and lower the loading jib and the other of which is independently usable to tilt any load carried by said jib.

* * * * *